United States Patent [19]

Giebeler

[11] Patent Number: 4,947,711

[45] Date of Patent: Aug. 14, 1990

[54] CHAMPAGNE BOTTLE OPENER

[76] Inventor: Ben F. Giebeler, 3670 El Camino, San Bernardino, Calif. 92404

[21] Appl. No.: 295,888

[22] Filed: Jan. 11, 1989

[51] Int. Cl.[5] ..... B67B 7/06

[52] U.S. Cl. ..... 81/3.37; 81/3.29

[58] Field of Search ..... 81/3.29, 3.37, 3.36, 81/3.4, 3.07, 3.08

[56] References Cited

U.S. PATENT DOCUMENTS

| | | | |
|---|---|---|---|
| 2,761,338 | 9/1956 | Hardy | 81/3.29 |
| 3,800,345 | 4/1974 | Feliz | 81/3.37 |
| 4,598,613 | 7/1986 | Baum | 81/3.37 |
| 4,729,267 | 3/1988 | Giebeler | 81/3.29 |
| 4,798,106 | 1/1989 | Foster | 81/3.29 |

*Primary Examiner*—Roscoe V. Parker
*Attorney, Agent, or Firm*—Lyon & Lyon

[57] ABSTRACT

A device for the controlled removal and re-insertion of the cork used with the conventional champagne bottle. The device has a first member having a cavity which is sized and shaped to straddle the neck of the bottle, with a plastic insert to specifically fit the circumferential rib which the conventional champagne bottle has near the spout. A second member contains annular ridges to slide onto and grip the head of the cork. A single handle utilizes a rack gear mechanism to move the two members apart, linearly and under leverage, so that the cork can be removed and re-inserted with ease.

9 Claims, 1 Drawing Sheet

CHAMPAGNE BOTTLE OPENER

BACKGROUND OF THE INVENTION

The device of this invention pertains to a mechanical apparatus for the controlled removal and re-insertion of the cork from and into the conventional champagne bottle which has a circumferential rib around the neck of the bottle near the spout.

The unopened champagne bottle can be, particularly if agitated, under great pressure. Many people, ceilings, and light fixtures have been injured or damaged when struck by the champagne bottle cork, which can be propelled under great force when the bottle is opened. This problem is compounded when the cork is tightly stuck in the bottle such that great exertion is bottle is usually agitating the bottle, albeit unknowingly, in his or her attempts to open it. Also, because the person is intent upon winning out over the stubborn cork, the person may not be as careful as he or she should be in preventing the released cork from striking someone or something. Lastly, when the bottle is agitated, then opened, a significant portion of the champagne inside is lost.

These problems have previously been discussed in Giebeler, U.S. Pat. No. 4,729,267, wherein several embodiments of a champagne bottle opener are disclosed.

One of the draWbacks encountered With the prior art devices was that they did not work equally well with all of the various sizes and shapes of bottles and corks on the market. The champagne or sparkling wine industry is expanding, with more companies producing marketed products, so there is an expanding number of different bottle and cork shapes available. Moreover, it appears that innovation in the design and material for corks is further changing and increasing the cork configurations to which the preferred cork remover will be adaptable. Therefore, there exists a need for a cork remover that is so adaptable.

SUMMARY OF THE INVENTION

The invention disclosed constitutes an improvement over the embodiments shown in U.S. Pat. No. 4,729,267 in that the interior portion of the upper member of the device is fitted with several annular ridges that slightly deform and securely grip the head of the cork, regardless of its configuration. Further improvements comprise a removable grooved plastic insert which fits into a recess in the lower member into which the neck of the bottle is inserted. A pliable material that conforms to the bottle shape can be used, or different plastic inserts, each having a shape that corresponds to the shape of a different bottle configuration, can be made available and interchangeable so that the device is adaptable for use with a broad spectrum of bottle shapes. Lastly, the single-handled action whereby the upper member (which grasps the bottle cork) is separated from the lower member (which grasps the neck of the bottle) comprises a radial gear on the handle which is journaled to the lower member, and which mates with a rack gear which is formed in the upper member. This produces the same lineal, perpendicular (vis-a-vis the plane in which the lower member resides) movement of the upper member from the lower member so that the cork can be easier removed and reinserted. This action is simple, easy to manufacture, compact, and aesthetically pleasing.

It is therefore an object of the invention to provide an improved champagne bottle opener.

DETAILED DESCRIPTION OF THE PREFERRED EMBODIMENTS

Figure 1:
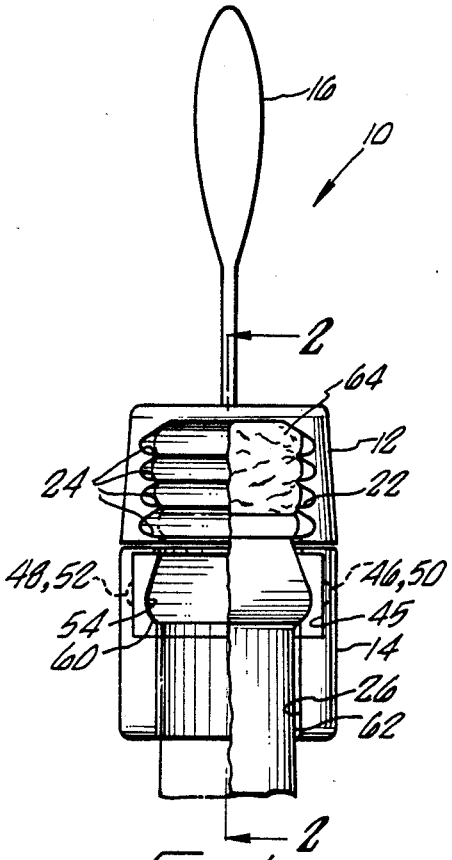
FIG. 1 is a front elevation view of the champagne bottle opener with the bottle and cork partially broken away.

Turning in detail to the drawings, FIGS. 1–4 illustrate the champagne bottle opener 10 which comprises generally an upper member 12, a lower member 14, and a handle 16.

The upper member 12 is substantially semi-cylindrical in shape and open on one side, having a vertically-oriented semicylindrical channel 22 whose diameter is appropriately sized to accept the conventionally-sized corks of champagne bottles. The channel 22 is lined with approximately four annular ridges 24 which protrude into channel 22 and therefore slightly deform and securely grip the surface of either plastic or natural corks. A vertically-oriented rack gear 18 fits within a pocket 19 located on one side of upper member 12 centrally between rearwardly extending flanges 20. Although depicted as a separate part in the figures, the rack gear 18 could be integrally formed in upper member 12.

Lower member 14 is also substantially semi-cylindrical in shape, and has a pair of rearwardly extending flanges 25 which are of a size so as to fit slidably between flanges 20. A vertically-oriented semi-cylindrical channel 26, which is open on one side to allow the neck of a champagne bottle to slide into channel 26 is formed in lower member 14. A handle 16 has a circular head 27 which is sized and shaped so as to fit snugly yet slidably within the space between flanges 25 where it is journaled upon journal pin 28. Handle head 27 contains teeth 30 around approximately 60% of its circumference which mesh with teeth 32 in rack gear 18 to cause upper member 12 and lower member 14 to separate linearly and under force as handle 16 rotates downward around journal pin 28. It will be appreciated that the interaction of teeth 30 on rack gear 18 and of handle 16 and journal pin 28 serve to hold the assemblage together, and to limit the distance which upper member 12 can separate from lower member 14.

Figure 2:
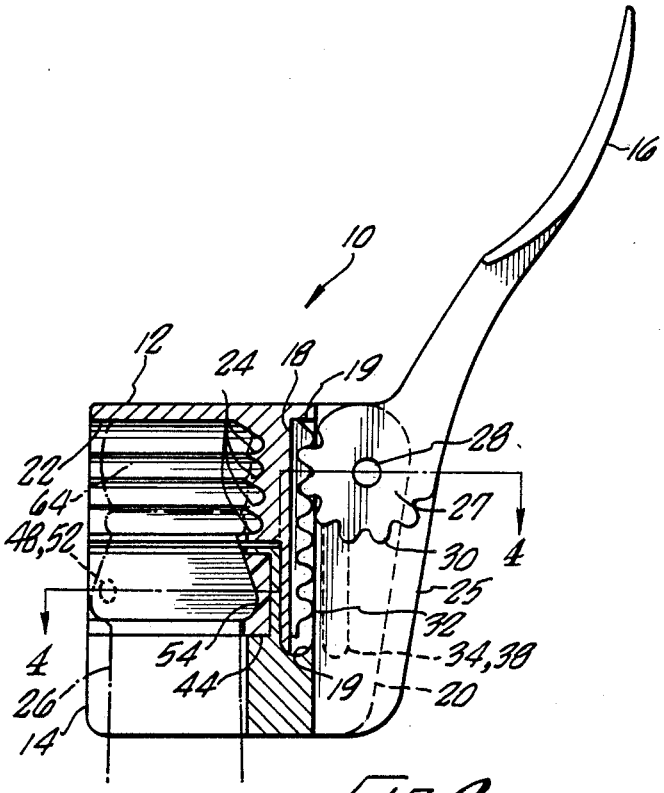
FIG. 2 is a cross-sectional side view of the champagne bottle opener in the closed position along line 2—2 of FIG. 1 with the bottle and cork in a phantom view.
Figure 4:
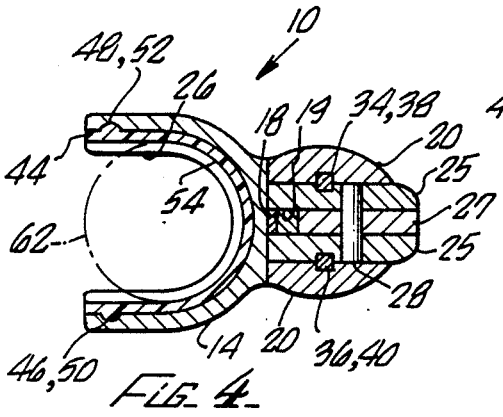
FIG. 4 is a cross-sectional top view of the champagne bottle opener taken along line 4—4 of FIG. 2.
Figure 3:
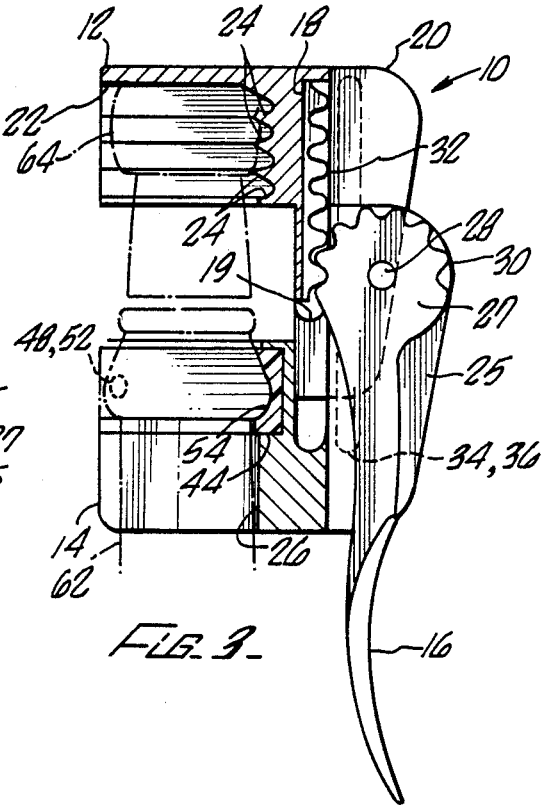
FIG. 3 is a cross-sectional side view of the champagne bottle opener of FIG. 2 in the open position.

Illustrated directly in FIG. 4 and in phantom in FIGS. 2 and 3 are vertically-oriented keys 34, 36 and pockets 38, 40 in flanges 25. (Key 36 and pocket 40 are not shown in FIGS. 2 and 3). Keys 34, 36 slide in vertically-oriented keyways (not shown) located in flanges 20 on upper member 12. Keys 34, 36 are effective means of keeping upper member 12 and lower member 14 in proper relation to each other while absorbing loads and reducing friction as the opener 10 is opened and closed. Keys 34, 36 could also be made an integral part of flanges 25 on lower member 14.

A replaceable insert 44 fits within recess 45 in channel 26 in lower member 14. Insert 44 is made of a plastic or rubber-like material which has a pliable texture in order to form around variations in the size and shape of the rib on the necks of champagne bottles. In order to securely grip insert 44, slight indentations 46, 48 near the open side of channel 24 in lower member 14 accommodate similarly-shaped nodes 50, 52 located near the front sides of insert 44. Referring to FIGS. 2 and 3, insert 44 contains annular groove 54 which can be varied in size and shape (by using various replaceable inserts) in order to fit the various champagne bottles used throughout the world.

To open a champagne bottle using this device, an appropriate insert 44, having an interior configuration which best conforms to the exterior configuration of the neck rib 60 on the champagne bottle 62, is selected and placed within recess 45 in lower member 14. The handle 16 is raised (as shown in FIG. 2) so as to bring upper member 12 and lower member 14 together. In this position, the device is placed alongside the bottle and cork assemblage and pushed laterally so that the insert 44 slides onto the circumferential rib 60 on the bottle 62, and the upper member 12 slides onto the cork head 64. The ridges 24 in upper member 12 are designed to "dig" into the cork head 64. Therefore, the horizontal distance between the ribs (as best seen in FIG. 1) is designed to be slightly less than the smallest known cork head diameter. Because all known cork heads are somewhat malleable, the larger diameter cork heads are easily mounted, although slightly more pressure may be necessary. If the cork head is unusually tall, or if the rib 60 is unusually low on the bottle, the device can be opened slightly before insertion onto the bottle and cork. Because the ridges 24 grip the cork head, it is not necessary to fully envelope the cork head within upper member 12 by having a flange which fits under the cork head. Instead, the ridges 24 provide all of the gripping force which is necessary to remove or reinsert even the most stubborn corks. Moreover, because the cork and bottle are positively held by this device (Whereas the prior art devices did not do so), the device is more stable on the bottle and provides a better, more positive action in cork removal and reinsertion. To remove the cork, handle 16 is rotated downward, thereby separating the upper and lower members. Reinsertion of the cork is accomplished by rotating the handle upward.

Thus, an improved champagne bottle opener is disclosed which can be operated with one hand, and which more positively and safely opens and closes champagne bottles. While an embodiment and an application of this invention have been shown and described, it would be apparent to these skilled in the art that more modifications are possible without departing from the inventive concepts herein. The invention, therefore, is not to be restricted except in the spirit of the appended claims.

What is claimed is:

1. In a device for controlled removal or insertion of a cork from and into a champagne bottle having a neck and a circumferential rib thereon, the device comprising a first member having a U-shaped channel to fit laterally onto the neck of the champagne bottle; a second member having a U-shaped channel to fit laterally onto the head of the cork; and means for separating the first and second members under leverage; the improvement comprising a plurality of sharp-edged annular ridges formed on the interior of said U-shaped channel in said second member, said ridges designed and constructed to be slidable onto the head of the cork and to slightly deform and thereby securely grip the head of the cork when the device is mounted thereon.

2. The invention of claim 1 further comprising a recess in said U-shaped channel in said first member and a U-shaped insert which is fitable within said recess, said U-shaped insert having an interior configuration which approximates the exterior configuration of the neck and rib of the champagne bottle to be opened to that there is close mating therebetween, and means for holding said insert within said recess, said means comprising at least a pair of detents in said recess into which fit corresponding nodes on said insert.

3. The device of claim 2 wherein said insert is of a pliable material which will deform slightly so as to be adaptable to different bottle configurations.

4. A device for controlled removal of a cork from a standard champagne bottle which has a circumferential rib on its neck near the spout, the device comprising:

(a) a first or lower member having a U-shaped channel therein, said channel having a bottle-gripping means which approximates a portion of the exterior configuration of the neck and spout area of said bottle such that it will slide laterally onto said neck of said bottle, but will not more longitudinally relative to said bottle;

(b) a second or upper member movably and coaxially attached to said first member, said second member having a U-shaped channel therein having a configuration such that it will slide laterally onto and engage said cork head when said cork head is in said bottle in order to remove it from said bottle whenever said first and said second members are separated; and (c) handle and linkage means for causing said first member and said second member to separate and return linearly, be removed from or reinserted into said bottle, wherein said handle and linkage means is a single elongated handle with one end journaled centrally to the side of said first member opposite said U-shaped channel at a journal point, said handle having, at its end thereof journaled to said first member, ratchet teeth formed in a semi-circular configuration with said journal point of said handle being the center point of said semi-circular configuration, and a rack gear engaged by said ratchet teeth on said handle, such that as said handle is rotated downward, said second member is moved away from said first member, and such that as said handle is rotated upward, said second member is moved toward said first member.

5. The device of claim 4 further comprising guide means attached to both said first member and said second member for guiding the linear separation and return of said first and second members.

6. The device of claim 5 wherein said guide means comprises two keys positioned in cut-outs on both sides of the portion of said first member which supports said handle journal pin.

7. The device of claim 4 wherein said bottle-gripping means comprises a user-replaceable U-shaped insert of a pliable texture which conforms to fit snugly around particular shapes of champagne bottle necks.

8. The device of claim 4 in which said channel in said second member has an interior lined with more than one U-shaped annular ridge which contacts and slightly deforms said cork head in order to facilitate removal of said cork head from said bottle whenever said first and said second members are separated.

9. A device for controlled removal of a cork from a standard champagne bottle which has a circumferential rib on it s neck near the spout, the device comprising:

(a) a first or lower member having a U-shaped channel therein, said channel having a bottle-gripping means which approximates a portion of the exterior configuration of the neck and spout area of said bottle such that it will slide laterally onto said neck of said bottle, but will not more longitudinally relative to said bottle;

(b) a second or upper member movably and co-axially attached to said first member, said second member having a U-shaped channel therein having a configuration such that it will slide laterally onto and engage said cork head when said cork head is in said bottle in order to remove it from said bottle whenever said first and said second members are separated;

(c) handle and linkage means for causing said first member and said second member to separate and return linearly, be removed from or reinserted into said bottle, wherein said handle and linkage means comprises an elongated handle with one end journaled one side of said first member at a journal point, said handle having, at its end thereof journaled to said first member, ratchet teeth formed in a semi-circular configuration with said journal point of said handle being the center point of said semi-circular configuration, and a rack gear engaged by said ratchet teeth on said handle, such that as said handle is rotated downward, said second member is moved away from said first member, and such that as said handle is rotated upward, said second member is moved toward said first member; and (d) guide means attached to both first and said second member for guiding the linear separation and return of said first and second members, said guide means comprising two keys positioned in cut-outs on both sides of the portion of said first member which supports said handle journal pin.

* * * * *